US006645321B2

(12) United States Patent
Sigworth

(10) Patent No.: US 6,645,321 B2
(45) **Date of Patent: *Nov. 11, 2003**

(54) METHOD FOR GRAIN REFINEMENT OF HIGH STRENGTH ALUMINUM CASTING ALLOYS

(76) Inventor: Geoffrey K. Sigworth, 116 Derby St., Johnstown, PA (US) 15905

( * ) Notice: Subject to any disclaimer, the term of this patent is extended or adjusted under 35 U.S.C. 154(b) by 139 days.

This patent is subject to a terminal disclaimer.

(21) Appl. No.: 09/804,340

(22) Filed: Mar. 13, 2001

(65) Prior Publication Data

US 2003/0190252 A1 Oct. 9, 2003

Related U.S. Application Data

(63) Continuation-in-part of application No. 09/657,268, filed on Sep. 7, 2000, now Pat. No. 6,368,427, which is a continuation-in-part of application No. 09/393,503, filed on Sep. 10, 1999, now abandoned.

(51) Int. Cl.[7] ..... C21D 9/08
(52) U.S. Cl. ..... 148/523; 148/549
(58) Field of Search ..... 148/439, 523, 148/549, 688

(56) References Cited

U.S. PATENT DOCUMENTS

| | | | |
|---|---|---|---|
| 684,707 | A | 10/1901 | Murmann |
| 995,113 | A | 6/1911 | Claessen |
| 1,099,561 | A | 6/1914 | McAdams |
| 1,130,785 | A | 3/1915 | Wilm |
| 1,261,987 | A | 4/1918 | Wilm |
| 1,273,762 | A | 7/1918 | Fuller |
| 1,352,322 | A | 3/1920 | Stay |
| 1,508,556 | A | 9/1924 | Jeffries |
| 1,555,959 | A | 10/1925 | Fresneau |
| 1,578,979 | A | 3/1926 | Fuller et al. |
| 1,629,699 | A | 5/1927 | Guertler et al. |
| 1,760,549 | A | 5/1930 | Fuller et al. |
| 1,860,947 | A | 5/1932 | Pacz |
| 2,062,329 | A | 12/1936 | Nock |

(List continued on next page.)

FOREIGN PATENT DOCUMENTS

| | | |
|---|---|---|
| CA | 441793 | 6/1947 |
| GB | 542886 | 1/1942 |
| GB | 552972 | 5/1943 |

OTHER PUBLICATIONS

Pearson, J.; Birch, M.E.J., Effect of the Titanium:Boron Ratio on the Efficiency of Aluminum Grain–Refining Alloys J. Met. (1979), 31(11). 27–31, 1979.*

V. de L. Davies, "The Influence of Grain Size on Hot Tearing," *The British Foundryman*, vol. 63, Apr. 1970, pp. 93–101.

G.S. Cole et al, "Grain Refinement in Al and Al Alloys," *AFS Transactions*, vol. 80, 1972, pp. 211–218.

(List continued on next page.)

*Primary Examiner*—Sikyin Ip
(74) *Attorney, Agent, or Firm*—Andrew Alexander

(57) ABSTRACT

A method of casting an aluminum base alloy to provide a cast product having improved hot crack resistance in the as-cast condition, the method comprising providing a melt of an aluminum base alloy comprised of 2.0 to less than 3.5 wt. % Zn, 2.5 to less than 4 wt. % Mg, a maximum of 2 wt. % total Fe and Mn in combination, max. 0.3 wt. % Si, max. 0.6 wt. % Cu, optionally up to 0.5 wt. % Cr, dissolved Ti in the range of about 0.005 to 0.1 wt. %, and an undissolved nucleating agent in the range of about 0.002 to 0.1 wt. % for grain refining, the balance comprised of aluminum, incidental elements and impurities. A nucleating agent selected from the group consisting of metal carbides, aluminides and borides is added to the melt to provide an undissolved nucleating agent therein, in the range of 0.002 to 0.1 wt. % for grain refining. The said alloy is solidified to provide a cast product having a grain size of less than 125 microns and free of hot cracks.

9 Claims, 1 Drawing Sheet

U.S. PATENT DOCUMENTS

| | | | | |
|---|---|---|---|---|
| 2,090,894 | A | | 8/1937 | Mantuenaga |
| 2,090,895 | A | | 8/1937 | Mantuenaga |
| 2,109,117 | A | | 2/1938 | Mantuenaga |
| 2,116,273 | A | | 5/1938 | Mantuenaga |
| 2,123,886 | A | | 7/1938 | Fischer |
| 2,146,330 | A | | 2/1939 | Comstock |
| 2,240,940 | A | | 5/1941 | Nock |
| 2,249,740 | A | | 7/1941 | Bonsack |
| 2,274,657 | A | | 3/1942 | Bonsack |
| 2,280,170 | A | | 4/1942 | Stroup |
| 2,290,016 | A | | 7/1942 | Bonsack |
| 2,290,017 | A | | 7/1942 | Bonsack |
| 2,290,018 | A | | 7/1942 | Bonsack |
| 2,290,019 | A | | 7/1942 | Bonsack |
| 2,290,020 | A | | 7/1942 | Bonsack |
| 2,290,021 | A | | 7/1942 | Bonsack |
| 2,290,022 | A | | 7/1942 | Bonsack |
| 2,290,023 | A | | 7/1942 | Bonsack |
| 2,290,024 | A | | 7/1942 | Bonsack |
| 2,290,025 | A | | 7/1942 | Bonsack |
| 2,290,026 | A | | 7/1942 | Bonsack |
| 2,381,219 | A | | 8/1945 | Le Baron |
| 2,459,492 | A | | 1/1949 | Bradbury et al. |
| 2,522,575 | A | | 9/1950 | Hall et al. |
| 2,709,680 | A | | 4/1955 | Criner |
| 2,749,239 | A | | 6/1956 | Sicha et al. |
| 2,784,126 | A | | 3/1957 | Criner |
| 3,288,601 | A | | 11/1966 | Flemings et al. |
| 3,304,209 | A | | 2/1967 | Anderson et al. |
| 3,322,533 | A | | 5/1967 | Martin |
| 3,347,665 | A | | 10/1967 | Miller et al. |
| 3,414,406 | A | | 12/1968 | Doyle et al. |
| 3,475,166 | A | | 10/1969 | Raffin |
| RE26,907 | E | | 6/1970 | Doyle et al. |
| 3,539,308 | A | | 11/1970 | Nowack |
| 3,561,954 | A | | 2/1971 | Brook |
| 3,598,577 | A | | 8/1971 | Stonebrook |
| 3,634,075 | A | | 1/1972 | Hoff |
| 3,676,111 | A | | 7/1972 | Wiesner et al. |
| 3,759,758 | A | | 9/1973 | Hatano et al. |
| 3,762,916 | A | | 10/1973 | Kirman |
| 3,765,877 | A | | 10/1973 | Sperry et al. |
| 3,785,807 | A | | 1/1974 | Backerud |
| 3,843,357 | A | | 10/1974 | Niimi et al. |
| 3,857,705 | A | | 12/1974 | Miyasaka et al. |
| 3,923,557 | A | | 12/1975 | Anthony et al. |
| 3,925,067 | A | | 12/1975 | Sperry et al. |
| 3,933,476 | A | | 1/1976 | Chopra et al. |
| 3,945,861 | A | | 3/1976 | Anderson et al. |
| 3,993,476 | A | | 11/1976 | Koike |
| 4,062,704 | A | | 12/1977 | Sperry et al. |
| 4,063,936 | A | | 12/1977 | Nagase et al. |
| 4,224,065 | A | | 9/1980 | Jaquet et al. |
| 4,294,625 | A | | 10/1981 | Hyatt et al. |
| 4,298,408 | A | | 11/1981 | Langdon et al. |
| 4,336,075 | A | | 6/1982 | Quist et al. |
| 4,610,733 | A | | 9/1986 | Sanders, Jr. et al. |
| 4,612,073 | A | | 9/1986 | Guzowski et al. |
| 4,673,551 | A | | 6/1987 | Sugiyama et al. |
| 4,686,083 | A | | 8/1987 | Takizawa et al. |
| 4,710,348 | A | | 12/1987 | Brupbacher et al. |
| 4,740,250 | A | | 4/1988 | Ahn et al. |
| 4,748,001 | A | | 5/1988 | Banerji et al. |
| 4,761,267 | A | | 8/1988 | Bakeno et al. |
| 4,772,342 | A | | 9/1988 | Polmear |
| 4,812,290 | A | | 3/1989 | Sigworth |
| 4,828,794 | A | | 5/1989 | Scott et al. |
| RE33,092 | E | | 10/1989 | Sanders, Jr. et al. |
| 4,873,054 | A | | 10/1989 | Sigworth |
| 4,902,475 | A | | 2/1990 | Apelain et al. |
| 5,055,256 | A | | 10/1991 | Sigworth et al. |
| 5,100,488 | A | | 3/1992 | Sigworth |
| 5,115,770 | A | | 5/1992 | Yen et al. |
| 5,120,372 | A | | 6/1992 | Yen et al. |
| 5,180,447 | A | | 1/1993 | Sigworth et al. |
| 5,213,639 | A | | 5/1993 | Colvin et al. |
| 5,230,754 | A | | 7/1993 | Setzer et al. |
| 5,240,517 | A | | 8/1993 | Matsumoto et al. |
| 5,376,192 | A | | 12/1994 | Cassada, III |
| 5,512,112 | A | | 4/1996 | Cassada, III |
| 5,516,382 | A | | 5/1996 | Raynaud |
| 5,554,234 | A | | 9/1996 | Takeuchi et al. |
| 5,571,346 | A | * | 11/1996 | Bergsma |
| 5,593,516 | A | | 1/1997 | Cassada, III |
| 5,618,358 | A | | 4/1997 | Davisson et al. |
| 5,630,889 | A | | 5/1997 | Karabin |
| 5,652,063 | A | | 7/1997 | Karabin |
| 5,665,306 | A | | 9/1997 | Karabin |
| 5,738,735 | A | | 4/1998 | Bechet |
| 5,795,541 | A | | 8/1998 | Tanigawa et al. |
| 5,800,927 | A | | 9/1998 | Karabin |
| 5,803,994 | A | | 9/1998 | Coats, II et al. |
| 5,863,359 | A | | 1/1999 | Karabin et al. |
| 5,879,475 | A | | 3/1999 | Karabin |
| 5,897,720 | A | | 4/1999 | Dorward |
| 5,906,689 | A | | 5/1999 | Sircar |
| 5,916,385 | A | | 6/1999 | Coats, II et al. |
| 5,935,295 | A | * | 8/1999 | Megy |
| 5,989,495 | A | | 11/1999 | Isayama et al. |
| 6,368,427 | B1 | * | 4/2002 | Sigworth |

OTHER PUBLICATIONS

A. Cibula et al, "The Effect of Grain Size on the Tensile Properties of High Strength Cast Aluminum Alloys," *The Journal of the Inst. of Metals*, vol. 76, 1949–1950, pp. 361–376.

A. Cibula, "The Grain Refinement of Aluminum Alloy Castings by Additions of Titanium and Boron," *The Journal of the Inst. of Metals*, vol. 80, 1951–52, pp. 1–16.

G.E. Nagel, Jr., "Capabilities and Applications for Permanent Mold Casting Aluminum–Copper–Magnesium Alloys," *Procedings of Aluminum Conference: State of the Art*, Detroit, Michigan, Sep. 25–26, 1979, Cast Metals Institute of the American Foundrymen's Soc., Des Plaines, Illinois, 1979, pp. 85–99.

K. Sato et al, "Grain Refining of Al–4.5 Cu Alloy by Adding an Al–30TiC Master Alloy," *Metallurgical and Materials Transactions A*, vol. 29A, 1998, pp. 1707–1710.

G.D. Scott et al "Fracture Toughness and Tensile Properties of Directionally Solidified Aluminum Foundry Alloys," Technology for Prenium Quality Castings, The Metallurgical Society, Warrendale, PA 1988, pp. 123–149.

L. Backerud et al, "The Relative Importance of Nucleation and Growth Mechanisms to Control Grain Size in Various Aluminum Alloys," *Light Metals 1996*, pp. 679–685.

M.A. Kearns et al, Effects of Solute Interactions on Grain Refinement of Commercial Aluminum Alloys, *Light Metals 1997*, pp. 655–661.

J.A. Spittle et al, "The Grain Refinement of Al–Si Foundry Alloys," *Light Metals 1997*, pp. 795–800.

W. Reif et al, "Investigation of the Effect of Silicon on Grain Refinement of Aluminum with Al–Ti–B Master Alloys," *Z. Metallkunde*, vol. 70, 1979, pp. 396–399.

M. Abdel–Reihim et al, "Effect of Solute Content on the Grain Refinement of Binary Alloys," *J. Materials Science*, vol. 22, 1987, pp. 213–218.
W. Jie et al, "Effect of Alloying Element Contents on the Solidification Structure of Al–Cu and Al–Si Alloys," *Metall*, vol. 46, 1992, pp. 1243–1247.
J. J. Wanqu et al, "Effect of Cu Content on Grain Refinement of an Al–Cu Alloy with AlTi6 and AlTi5B1 Refiners," *Z. Metallkunde*, vol. 84, 1993, pp. 445–450.
J.E.C. Hutt et al, "The Effects of Growth Restriction and Effective Nucleant Potency on Grain Size and Morphology in Al–Si and Al–Cu Alloys," *Light Metals 1999*, pp. 685–692.
H.E. Vatne et al, Experimental Investigations of the Effect of Various Alloying Elements on As–Cast Grain Size of Wrought Al–Alloys, *Light Metals 1999*, pp. 787–792.
A. Cibula, "The Mechanism of Grain Refinement of Sand Castings in Aluminum Alloys," *The Journal of the Inst. of Metals*, vol. 786, 1949–1950, pp. 321–360.
A. Kamino et al, "Mechanical Properties in Aluminum Alloy Castings Grain Refined by Titanium," *Imono*, vol. 51, 1979, pp. 408–413.
Polmear et al, "Design and Development of an Experimental Wrought Aluminum Alloy for Use at Elevated Temperatures", *Metallurgical Transactions A*, vol. 19A, Apr. 1998, pp. 1027–1035.
E.E. Stonebrook and R.H. Ewing: "High Strength Aluminum Casting Alloy X149," *AFS Transactions*, vol. 76, pp. 230–236 (1968).
W.E. Sicha and H.Y Hunsiker: "Characteristics of Some Alumlinum–Zinc–Magnesium–Copper Casting Alloys," *AFS Transactions*, vol. 58, pp. 333–345 (1950).
S.P. Nowack: "Mechanical Properties of a High Strength Cast Al–Zn–Mg Alloy," *AFS Transactions*, vol. 80, pp. 25–36 (1972).
L.W. Eastwood and L.W. Kempf: "Aluminum–Zinc–Magnesium Copper Casting Alloys," *AFS Transactions*, vol. 56, pp. 100–115 (1948).
B. Chamberlain, S. Watanabe and V.J. Zabek: "A Natural Aging Alloy Designed for Permanent Mold Use," *AFS Transactions*, vol. 85, pp. 133–142 (1977).
W. Bonsack: "High Strength Nonheat–Greated Aluminum Casting Alloys," *AFS Transactions*, vol. 60, pp. 453–461 (1952).
Registration Record of International Alloy Designations and Chemical Composition Limits for Wrought Aluminum and Wrought Aluminum Alloys, The Aluminum Association, Inc., Jun. 1994.
Registration Record of International Alloy Designations and Chemical Composition Limits for Aluminum Alloys in the Form of Castings and Ingot, The Aluminum Association, Inc., Jan. 1989.

* cited by examiner

METHOD FOR GRAIN REFINEMENT OF HIGH STRENGTH ALUMINUM CASTING ALLOYS

CROSS REFERENCE TO RELATED APPLICATIONS

This application is a continuation-in-part of U.S. Ser. No. 09/657,268, now U.S. Pat. No. 6,368,427 filed Sep. 7, 2000, which is a continuation in part of U.S. Ser. No. 09/393,503, Sep. 10, 1999 now abandoned.

BACKGROUND OF THE INVENTION

This invention relates to improved aluminum base alloys having improved hot crack resistance when solidified into cast products.

It is well known that pure aluminum is soft. Thus, in order to produce high strength from aluminum, significant amounts of other elements must be added. These chemical additions strengthen the metal considerably, but have the problem that they tend to form low melting point euthenics. The practical consequence of this, from the foundryman's point of view, is that high strength casting alloys have a wide freezing range.

Relatively pure aluminum alloys (greater than about 99 wt. % Al) freeze over a temperature interval of 5–10° C., or less. High strength casting alloys, on the other hand, usually contain less than 95 wt. % Al and freeze over a temperature interval of 50 to 100°, or more.

During solidification of high strength casting alloys, there is a 'mushy' mixture of solid and liquid metal present in the mold as it cools through this wide freezing range. There is thermal contraction of solid during this cooling and solidification on process, and the shrinkage of the solid has the problem that it often results in the formation of hot cracks (hot cracks are also called hot tears). Hot cracking of high strength casting alloys is a serious problem, and has prevented significant commercial use of many alloys, in spite of their excellent properties.

There are few examples of grain refining practices proposed specifically for casting alloys in the prior art. Sigworth and Guzowski (U.S. Pat. Nos. 5,055,256 and 5,150,447; and related foreign patents) discovered that an alloy containing a boride of "mixed" composition; $(Al,Ti)B_2$, gave the best results. They proposed a master alloy having a nominal composition of 2.5 wt. % Ti and 2.5% B for best grain refinement in casting alloys. This method of grain refinement did not produce smaller grain sizes, however. It only produced equivalent grain sizes at reduced cost. As such, this method of refinement does not represent a solution to the hot cracking problem in high strength casting alloys.

Arnberg, Halvorsen and Tondel (EP 0553533) have proposed a Si—B alloy refiner for use in casting alloys. Setzer et al (U.S. Pat. No. 5,230,754) have proposed an Al—Sr—B master alloy, to simultaneously grain refine and to modify the eutectic in Al—Si alloys. However, these methods do not produce the desired smaller grain sizes.

D. Apelian and J-J. A. Cheng have proposed an Al—Ti—Si master alloy (U.S. Pat. No. 4,902,475), but this alloy does not appear to be suitable for grain refinement of high strengh casting alloys.

In addition to the patents mentioned above, U.S. Pat. Nos. 3,634,075; 3,676,111; 785,807; 3,857,705; 3,933,476; 4,298,408; 4,612,073; 4,748,001; 4,812,290; and 6,073,677 disclose different master alloy compositions and methods of manufacture and use.

Other nucleating particles may be used and include several commercial master alloys for grain refining based on the Al—Ti—C system. These master alloys introduce microscopic TiC particles as nucleating agents into the melt. The TiC particles are disclosed in U.S. Pat. Nos. 4,710,348; 4,748,001; 4,873,054; and 5,100,488. Nucleating particles, such as sulfides, phosphides or nitrides (e.g., U.S. Pat. No. 5,100,488) may also by used.

It will be seen that there is still a great need for an improved aluminum alloy and method of grain refinement of high strength, aluminum-based casting alloys which permits use of high strength alloys without the attendant problem of hot cracking.

SUMMARY OF THE INVENTION

It is an object of this invention to provide an improved high strength aluminum alloy substantially free from hot cracking.

It is another object of this invention to produce a smaller grain size in cast parts made from high strength, aluminum-based casting alloys.

Yet, it is another object of this invention to reduce or eliminate the problem with hot cracking associated with solidification of these same casting alloys.

Still, it is another object of this invention to produce high strength casting alloys having a better distribution of gas porosity, smaller diameter gas pores, a lesser amount of porosity, and higher fatigue strength.

And still, it is another object of this invention to produce improved grain refinement of high strength, aluminum-based casting alloys at reduced cost.

These and other objects will become apparent from a reading of the specifications, examples and claims appended hereto.

In accordance with these objects there is provided a method of casting an aluminum base alloy to provide a cast product having improved hot crack resistance in the as-cast condition, the method comprising providing a melt of an aluminum base alloy comprised of 4 to less than 5 wt. % Cu, max. 0.1 wt. % Mn, 0.15 to 0.55 wt. % Mg, max. 0.4 wt. % Si max. 0.2 wt. % Zn, up to 0.4 wt. % Fe, the balance comprised of aluminum, incidental elements and impurities. The dissolved Ti in the melt is maintained in the range of about 0.005 to 0.05 wt. % to improve the resistance of the alloy to hot cracking. A nucleating agent selected from the group consisting of metal carbides, aluminides and borides is added to the melt to provide an undissolved nucleating agent therein in the range of about 0.002 to 0.1 wt. % for grain refining; and the melt is solidified to provide a cast product having a grain size of less than 125 microns, the cast product being free of hot cracks.

Another alloy in accordance with this invention is comprised of 4 to less than 5.2 wt. % Cu, 0.15 to 0.6 wt. % Mn, 0.15 wt. % to 0.6 wt. % Mg, max. 0.15 wt. % Si, max 0.2 wt. % Zn, up to 0.2 wt. % Fe, 0.4 to 1 wt. % Ag, dissolved Ti in the range of about 0.005 to 0.10 wt. %, and an undissolved nucleating agent in the range of about 0.002 wt. % for grain refining, the balance comprised of aluminum, incidental elements and impurities.

A third alloy in accordance with this invention is comprised of 3.8 to less than 4.6 wt. % Cu, 0.25 to 0.5 wt. % Mn, 0.25 to 0.55 wt. % Mg, max. 0.1 wt. % Si, up to 0.15 wt. % and 2.5 to 3.5 wt. % Zn, dissolved Ti in the range of about 0.005 to 0.05 wt. %, and an undissolved nucleating agent in the range of about 0.002 to 0.1 wt. % for grain refining, the balance comprised of aluminum, incidental elements and impurities.

Yet another alloy in accordance with this invention is comprised of 4.2 to less than 5 wt. % Cu, 0.2 to 0.5 wt. % Mn, 0.15 to 0.55 wt. % Mg, max. 0. 15 wt. % Si, up to 0.2 wt. % Fe, and max. 0.2 wt. % Zn, dissolved Ti in the range of about 0.005 to 0.1 wt. % and an undissolved nucleating agent in the range of about 0.002 to 0.1 wt. % for grain refining, the balance comprised of aluminum, incidental elements and impurities.

Other alloys in accordance with this invention are comprised as follows:

(1) 4.5 to less than 6.5 wt. % Zn, 0.2 to 0.8 wt. % Mg, max. 0.8% Fe, max. 0.4 wt. % Mn, max. 0.3 wt. % Si, max. 0.5% Cu, and 0.15 to 0.6 wt. % Cr, dissolved Ti in the range of about 0.005 to 0.05 wt. %, and an undissolved nucleating agent in the range of about 0.002 to 0.1 wt. % for grain refining, the balance comprised of aluminum, incidental elements and impurities;

(2) 6 to less than 7.5 wt. % Zn, 0.6 to 1 wt. % Mg, max. 0.15% Fe, max. 0.1 wt. % max. 0.1 wt. % Cu, max. 0.15 wt. % Si, and 0.06 to 0.4 wt. % Cr, dissolved Ti in the range of about 0.005 to 0.05 wt. %, and an undissolved nucleating agent in the range of about 0.002 to 0.1 wt. % for grain refining, the balance comprised of aluminum, incidental elements and impurities;

(3) 2.7 to less than 4.5 wt. % Zn, 1.4 to less than 2.4 wt. % Mg, max. 1.7% Fe, max. 0.6 wt. % Mn, max. 0.3 wt. % Si, max. 0.4 wt. % Cu, optionally 0.2 to 0.4 wt. % Cr, dissolved Ti in the range of about 0.005 to 0.05 wt. %, and an undissolved nucleating in the range of about 0.002 to 0.1 wt. % for grain refining, the balance comprised aluminum, incidental elements and impurities;

(4) 2.7 to less than 4.5 wt. % Zn, 1.4 to less than 2.4 wt. % Mg, max. 0.8 % Fe, 0.2 to less than 0.6 wt. % Mn, max. 0.2 wt. % Si, max. 0.2 wt. % Cu, optionally 0.2 to 0.4 wt. % Cr, dissolved Ti in the range of about 0.005 to 0.05 wt. %, and an undissolved nucleating agent in the range of about 0.002 to 0.1 wt. % for grain refining, the balance comprised of aluminum, incidental elements and impurities;

(5) 4.5 to less than 7 wt. % Zn, 0.25 to less than 0.8 wt. % Mg, max. 1.4 % Fe, max. 0.5 wt. % Mn, max. 0.3 wt. % Si, and 0.2 to less than 0.65 wt. % Cu, dissolved Ti in the range of about 0.005 to 0.1 wt. %, and an undissolved nucleating agent in the range of about 0.002 to 0.1 wt. % for grain refining, the balance comprised of aluminum, incidental elements and impurities.

In a preferred embodiment of this invention, the undissolved nucleating agent added to the above alloys is $TiB_2$ or TiC, and the insoluble Ti added is in the range of about 0.003 wt. % to 0.06 wt. %.

DETAILED DESCRIPTION OF THE PREFERRED EMBODIMENTS

Figure 1:
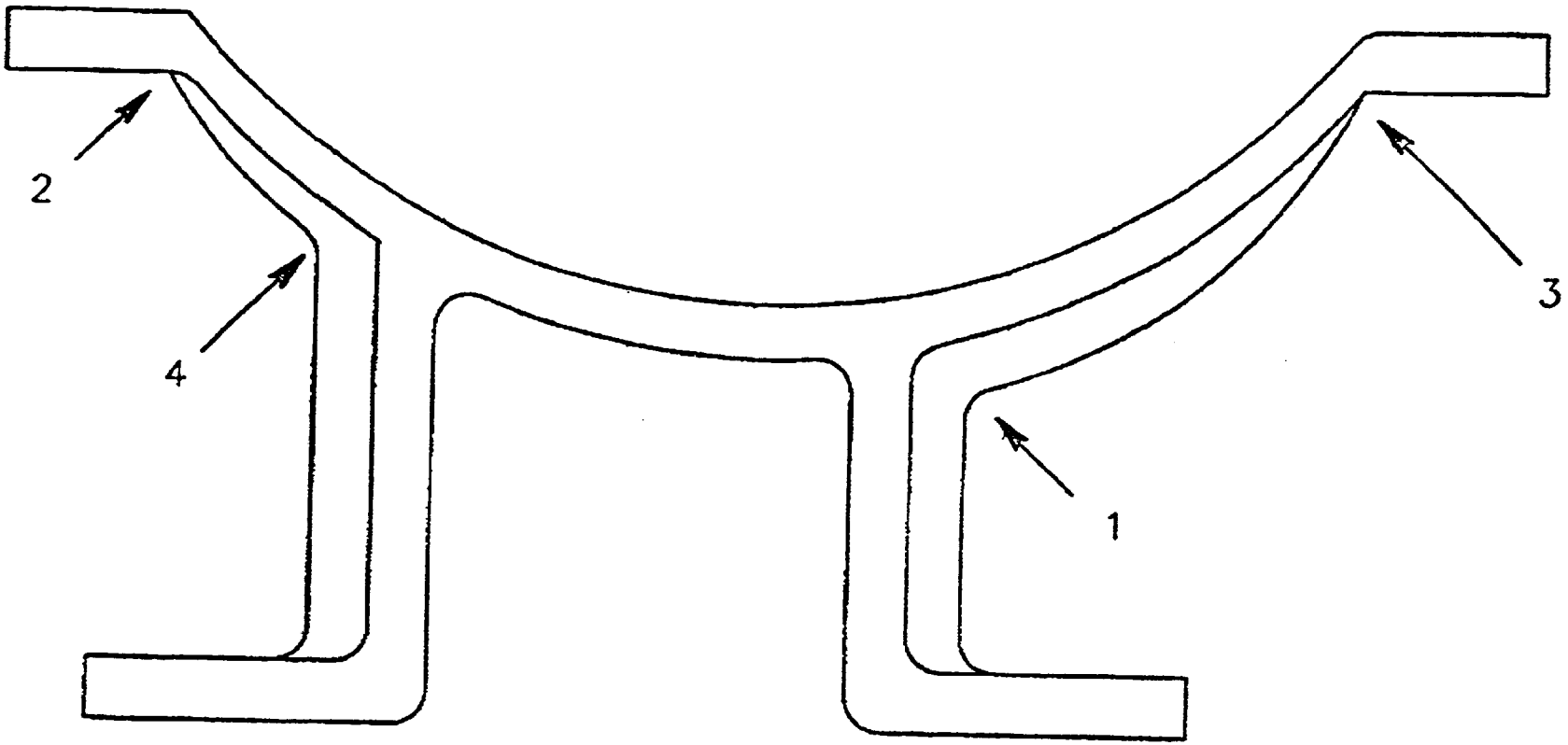
FIG. 1 illustrates a scale drawing of the casting used to evaluate the new grain refining practice and locations where cracks were observed.

The focus of this invention is on near net shape castings, and it will be useful to describe what is meant by this term. In particular, it is necessary to distinguish a near net shape cast product from a wrought product. Wrought alloy products are first cast into billets or ingots, which receive a substantial amount of mechanical deformation, followed by a high temperature homogenization heat treatment. A wrought alloy ingot or billet is rolled, extruded, or forged in order to obtain a product of the final desired shape and dimensions. A certain minimum amount of deformation is usually specified in the prior all, as an integral pail of the process required for the desired wrought microstructure. This minimum amount of deformation is typically in the range of 10∴30%, as measured by reduction in area, or engineering strain. By comparison, a near net shape cast product is substantially free from any mechanical deformation. The shape of the casting is usually very close to the final desired shape, except for machining operations, such as drilling of holes. Thus, substantially no deformation, or only very small amounts of deformation, is called for. Typically, net shape castings would only be placed on a press to straighten the product, in the event it had become warped or bent. Thus, a near net shape cast product is substantially free from any mechanical deformation. By the term substantially fee, we mean that the entire near net shape cast product receives no more than an average of 2–5% strain in processing. This small amount of deformation has no significant effect on the microstructure of the cast alloy.

In some cases a part or section of a near net shape casting may receive higher amounts of mechanical deformation. One common example of this is found in automotive suspension products, when the end of a ball joint is joined to a socket or hole in the casting by swaging or forging. The region of the net shape cast product near the ball joint may receive significant deformation, but the rest of the casting, usually a majority of its volume, will be substantially free from mechanical deformation.

This invention is concerned only with the grain size in the as-cast product, just as it comes out of the mold, and before it receives any further processing or heat treatment. The terms grain refinement and grain size herein refer to this condition.

It will be useful to consider some examples of alloys at this point. In the United States it is customary commercial practice to refer to alloy grades established by the Aluminum Association (900 19th. Street, Washington, D.C. 20006). These alloy grades are detailed in the "Registration Record of Aluminum Association (AA) Alloy Designations and Chemical Composition Limits for Aluminum Alloys in the Form of Casting and Ingot" and by reference thereto are incorporated herein by reference as if specifically set forth.

It will be useful to explain in more detail the nomenclature system adapted by the Aluminum Association, and to also define technical terms used herein.

The term "ingot" as used herein is meant to include semi-finished castings intended for further processing in the foundry and may include billet or slab or other solidification aluminum. This further processing may include bringing the ingot into the molted state, subjecting the resulting molten metal to various refining operations (such as degassing), and making small amounts of chemical additions (such as grain refiners) to the melt. The prepared molten alloy is then poured into a shaped mold, wherein it feezes. When it is fully solidified, the now solid alloy is removed from the mold to provide a casting.

It should be noted that reference to AA alloy 206 includes two separate alloys: 206.0 and 206.2. The term 206.0 refers to the alloy in the form of a casting. The term 206.2 refers to the name of the same alloy in the form of ingot.

For AA alloy 206, the AA chemical composition limits are the same for both, except the maximum allowable iron content in the casting (206.0) is 0.15%, whereas the maximum iron allowed in the ingot (206.2) is lower, 0.10%. This difference in iron content is common in most of the AA chemical composition limits. This results from the use of iron tools (ladles, skimmers, and so on) when handling the molten metal, and it is inevitable that a certain amount of this iron dissolves into the liquid aluminum and thereby is incorporated in the casting.

The suffix "0" in the alloy name (as in 206.0) always refers to a casting. The suffix "1" or "2" (both are used for historical reasons) always refers to ingot.

There is also an "A" version of 206 alloy (A206.0 and A206.2) which is similar to 206 except that lower quantities of undesirable impurities (Si, Fe, and Ni) are The term "high strength casting alloy" refers to an alloy which contains more than about 5% total alloying elements therein, and consequently, less than about 95% aluminum. A high strength casting will normally have a yield strength greater than about 30,000 pounds per square inch (psi) in the fully heat treated (aged) condition; or more than about 20,000 psi in castings which do not receive artificial aging, or heat treatment. The meaning of the term 'high strength casting alloy' is further elucidated by considering the following examples.

Alloy A356 is an alloy which finds extensive use in the production of high quality aerospace and automotive castings. It is also used for a wide variety of commercial castings. The alloy is easily cast, and through heat treatment can be brought to a wide variety of strength levels. A356 alloy contains 6.5 to 7.5 wt. % Si and 0.25 to 0.45 wt. % Mg, plus other normally occurring impurity elements at concentrations less than 0.2% each. The typical mechanical properties expected in permanent mold castings of this alloy (as published by the American Foundymen's Society in a book entitled *Aluminum Casting Technology*, 2nd. Ed.) when heat treated to the T6 (strongest) condition are shown below:

Typical Mechanical Properties for A356.0 Alloy

| Temper | Yield Strength (psi) | Ultimate Strength (psi) | Elongation (%) |
|---|---|---|---|
| T6 | 30,000 | 41,000 | 12.0 |

Another important alloy is A206.0, which contains 4.2–5.0 wt. % Cu, 0.2–0.35 wt. % Mn, 0.15–0.35 wt. % Mg and 0.15–0.30 wt. % Ti plus normally occurring impurity elements. Typical mechanical properties of permanent mold castings in this alloy are:

Typical Mechanical Properties for A206.0 Alloy

| Temper | Yield Strength (psi) | Ultimate Strength (psi) | Elongation (%) |
|---|---|---|---|
| T4 | 38,000 | 62,000 | 17.0 |
| T7 | 50,000 | 63,000 | 11.7 |

The AA 206 alloy casting is significantly stronger. This means that casting from this alloy could be made lighter for the same load bearing properties. In the case of automotive applications, this would mean a lighter, faster, and more fuel-efficient automobile. But the AA 206 alloy is rarely used, while 356 alloy is commonly used because the freezing range of 356 alloy is about 50°, and it is relatively immune to hot cracking. The freezing range of 206 alloy is about 120, and it is well known to be susceptible to hot cracking problems.

Another casting alloy, which exhibits excellent mechanical properties, was disclosed by Stonebrook in U.S. Pat. No. 3,598,577, and also in his paper entitled "High Strength Aluminum Casting Alloy X149, " published in AFS Transactions, Vol. 76, 1968, pp. 230–236. The properties given for an alloy which contained 4 wt. % Cu, 3 wt. % Zn, 0.35% Mg and 0.4 wt. % Mn are shown below.

Typical Mechanical Properties for 249 (X149) Alloy

| Temper | Yield Strength (psi) | Ultimate Strength (psi) | Elongation (%) |
|---|---|---|---|
| T4 | 38,800 | 63,500 | 21.0 |
| T63 | 55,300 | 66,500 | 9.5 |

The 249 alloy casting is also significantly stronger than 356 alloy castings, buy 249 is not now used commercially.

There are also a number of Al—Zn—Mg base alloys, listed in the table, which offer attractive properties for special applications. These alloys have extremely high impact resistance, and age naturally at room temperature. Thus, good strengths may be obtained without an artificial heat treatment. Not only does this save on production costs associated with heat treatment, but this characteristic also makes these alloys good candidates for welded or brazed assembles. This family of alloys is also useful in applications where one cannot tolerate the mechanical distortion normally caused by high temperature heat treatment. Impeller and fan blades are typical applications where distortion cannot be tolerated. It would also be useful to have a naturally aging alloy suitable for the die casting process. Properties for two of these alloys are given below, for the naturally aged 30 days (na) and fully aged (T6) conditions.

Typical Mechanical Properties for 712 and 771 Alloys

| Alloy & Temper | Yield Strength (psi) | Ultimate Strength (psi) | Elongation (%) |
|---|---|---|---|
| 712-na | 25,000 | 35,000 | 5 |
| 771-na | 30,000 | 40,000 | 5 |
| 771-T6 | 40,000 | 50,000 | 9 |

These alloys also have very attractive mechanical properties, but are seldom used commercially because they are difficult to cast. Hot cracking is a well-known problem in these alloys.

High strength casting alloys have the problem that they are more difficult to grain refine than pure aluminum or wrought alloys. Thus, the usual procedure has been to employ larger additions of titanium, and this procedure has often been codified into the Aluminum Association chemical composition limits. It will be seen that in the case of A206 alloy, a minimum Ti concentration of 0.15% is specified, and a maximum of 0.30% is allowed.

The situation is the same for a number of other high strength casting alloys. In the AA 200 series of alloys (which contain Al and 3.5–9 wt. % Cu) alloys 201, A201, 201, 203, 204, and 206 all have a specified minimum Ti content of 0.15%. Alloys 242 and 243 have a minimum Ti specified of 0.07% and 0.06% respectively. It will be noted that minimum Ti levels are also specified for AA alloys A355, B356, C356, A357, B357, C357, D357, 358, 393, 516, 535, B535, 712, 771 and 772 alloys, the composition of these alloys included herein by reference as if specifically set forth.

Even in casting alloys where no minimum Ti content is specified, the maximum allowable is quite high—generally 0.20 or 0.25 wt. % Ti—and the usual practice is to use fairly large amounts of Ti in the alloy.

Other aluminum alloys suitable for cast products included within the purview of this invention are set forth in the following table.

TABLE

| | Alloy Compositions in Weight Percent | | | | | | | | | |
|---|---|---|---|---|---|---|---|---|---|---|
| Alloy | Si | Fe | Cu | Mn | Mg | Cr | Ni | Zn | Sn | Ti |
| L201.0(1) | 0.20 | 0.15 | 4.0–5.2 | 0.20–0.60 | 0.15–0.6 | — | — | — | — | 0.01–0.16 |
| L201.2(1) | 0.20 | 0.10 | 4.0–5.2 | 0.20–0.60 | 0.15–0.6 | — | — | — | — | 0.01–0.10 |
| L201.0(1) | 0.05 | 0.10 | 4.0–5.0 | 0.20–0.40 | 0.15–0.35 | — | — | — | — | 0.01–0.16 |
| LA201.1(1) | 0.05 | 0.07 | 4.0–5.0 | 0.20–0.40 | 0.15–0.35 | — | — | — | — | 0.01–0.10 |
| LB201.0(2) | 0.05 | 0.05 | 4.5–5.0 | 0.20–0.50 | 0.25–0.35 | — | — | — | — | 0.01–0.16 |
| L203.0(3) | 0.30 | 0.50 | 4.5–5.5 | 0.20–0.30 | 0.10 | — | 1.3–1.7 | 0.10 | — | 0.01–0.12 |
| L203.2(3) | 0.20 | 0.35 | 4.8–5.2 | 0.20–0.30 | 0.10 | — | 1.3–1.7 | 0.10 | — | 0.01–0.10 |
| L204.0 | 0.35 | 0.40 | 4.2–5.2 | 0.10–0.15 | 0.35 | — | 0.05 | 0.10 | 0.05 | 0.01–0.11 |
| L204.2 | 0.15 | 0.10–0.20 | 4.2–4.9 | 0.05 | 0.15–0.35 | — | 0.03 | 0.05 | 0.05 | 0.01–0.05 |
| L206.0 | 0.20 | 0.20 | 4.2–5.0 | 0.20–0.50 | 0.15–0.35 | — | 0.05 | 0.10 | 0.05 | 0.01–0.16 |
| L206.2 | 0.10 | 0.10 | 4.2–5.0 | 0.20–0.50 | 0.15–0.35 | — | 0.03 | 0.05 | 0.05 | 0.01–0.10 |
| LA206.0 | 0.05 | 0.10 | 4.2–5.0 | 0.20–0.50 | 0.15–0.35 | — | 0.05 | 0.10 | 0.05 | 0.01–0.16 |
| LA206.2 | 0.05 | 0.07 | 4.2–5.0 | 0.20–0.50 | 0.15–0.35 | — | 0.03 | 0.05 | 0.05 | 0.01–0.10 |
| LA242.0 | 0.6 | 0.8 | 3.7–4.5 | 0.10 | 1.2–1.7 | 0.15–0.25 | 1.8–2.3 | 0.10 | — | 0.01–0.06 |
| LA242.1 | 0.6 | 0.6 | 3.7–4.5 | 0.10 | 1.3–1.7 | 0.15–0.25 | 1.8–2.3 | 0.10 | — | 0.01–0.07 |
| LA242.2 | 0.6 | 0.35 | 3.7–4.5 | 0.10 | 1.2–1.7 | 0.15–0.25 | 1;8–2.3 | 0.10 | — | 0.01–0.07 |
| L243.0(4) | 0.35 | 0.40 | 3.5–4.5 | 0.15–0.45 | 1.8–2.3 | 0.2–0.4 | 1.9–2.3 | 0.05 | — | 0.01–0.06 |
| L243.1(4) | 0.35 | 0.30 | 3.5–4.5 | 0.15–0.45 | 1.9–2.3 | 0.2–0.4 | 1.9–2.3 | 0.05 | — | 0.01–0.06 |
| 249.0 | 0.05 | 0.10 | 3.8–4.6 | 0.25–0.50 | 0.25–0.50 | — | — | 2.5–3.5 | — | 0.01–0.11 |
| L249.2 | 0.05 | 0.07 | 3.8–4.6 | 0.25–0.50 | 0.25–0.50 | — | — | 2.5–3.5 | — | 0.01–0.05 |
| LA355.0 | 4.5–5.5 | 0.09 | 1.0–1.5 | 0.05 | 0.45–0.6 | — | — | 0.05 | — | 0.01–0.03 |
| LA355.2 | 4.5–5.5 | 0.06 | 1.0–1.5 | 0.03 | 0.45–0.6 | — | — | 0.03 | — | 0.01–0.03 |
| LA357.0(5) | 6.5–7.5 | 0.20 | 0.20 | 0.10 | 0.40–0.7 | — | — | 0.10 | — | 0.01–0.03 |
| LA357.2(5) | 6.5–7.5 | 0.12 | 0.10 | 0.05 | 0.45–0.7 | — | — | 0.05 | — | 0.01–0.03 |
| LB357.0 | 6.5–7.5 | 0.09 | 0.05 | 0.05 | 0.40–0.6 | — | — | 0.05 | — | 0.01–0.03 |
| LB357.2 | 6.5–7.5 | 0.06 | 0.03 | 0.03 | 0.45–0.6 | — | — | 0.03 | — | 0.01–0.03 |
| LC357.0(5) | 6.5–7.5 | 0.09 | 0.05 | 0.05 | 0.45–0.7 | — | — | 0.05 | — | 0.01–0.03 |
| LC357.2(5) | 6.5–7.5 | 0.06 | 0.03 | 0.03 | 0.50–0.7 | — | — | 0.03 | — | 0.01–0.03 |
| LD357.0(5) | 6.5–7.5 | 0.20 | — | 0.10 | 0.55–0.6 | — | — | 0.05 | — | 0.01–0.09 |
| LA358.0(6) | 7.6–8.6 | 0.30 | 1.0–1.5 | 0.05 | 0.45–0.6 | — | — | 0.05 | — | 0.01–0.09 |
| LA358.2(7) | 7.6–8.6 | 0.20 | 1.0–1.5 | 0.03 | 0.45–0.6 | — | — | 0.03 | — | 0.01–0.09 |
| L516.0(8) | 0.3–1.5 | 0.35–1.0 | 0.30 | 0.15–0.40 | 2.5–4.5 | — | 0.25–0.40 | 0.20 | 0.10 | 0.01–0.09 |
| L516.1(8) | 0.3–1.5 | 0.35–0.7 | 0.30 | 0.15–0.40 | 2.6–45 | — | 0.25–0.40 | 0.20 | 0.10 | 0.01–0.09 |
| L535.0(9) | 0.15 | 0.15 | 0.05 | 0.10–0.25 | 6.2–7.5 | — | — | — | — | 0.01–0.10 |
| L535.2(10) | 0.10 | 0.10 | 0.05 | 0.10–0.25 | 6.6–7.5 | — | — | — | — | 0.01–0.10 |
| LB535.0 | 0.15 | 0.15 | 0.10 | 0.05 | 6.5–7.5 | — | — | — | — | 0.01–0.10 |
| LB535.2 | 0.10 | 0.12 | 0.05 | 0.05 | 6.6–7.5 | — | — | — | — | 0.01–0.10 |
| L705.0 | 0.20 | 0.80 | 0.20 | 0.4–0.6 | 1.4–1.8 | 0.2–0.4 | — | 2.7–3.3 | — | 0.01–0.11 |
| L705.1 | 0.20 | 0.60 | 0.20 | 0.4–0.6 | 1.5–1.8 | 0.2–0.4 | — | 2.7–3.3 | — | 0.01–0.05 |
| L707.0 | 0.20 | 0.80 | 0.20 | 0.4–0.6 | 1.8–2.4 | 0.2–0.4 | — | 4.0–4.5 | — | 0.01–0.11 |
| L707.1 | 0.20 | 0.60 | 0.20 | 0.4–0.6 | 1.9–2.4 | 0.2–0.4 | — | 4.0–4.5 | — | 0.01–0.05 |
| L710.0 | 0.15 | 0.50 | 0.35–0.65 | 0.05 | 0.6–0.8 | — | — | 6.0–7.0 | — | 0.01–0.11 |
| L710.1 | 0.15 | 0.40 | 0.35–0.65 | 0.05 | 0.65–0.8 | — | — | 6.0–7.0 | — | 0.01–0.05 |
| L711.0 | 0.3 | 0.7–1.4 | 0.35–0.65 | 0.05 | 0.25–0.45 | — | — | 6.0–7.0 | — | 0.01–0.11 |
| L711.1 | 0.3 | 0.7–1.1 | 0.35–0.65 | 0.05 | 0.30–0.45 | — | — | 6.0–7.0 | — | 0.01–0.05 |
| L712.0 | 0.30 | 0.50 | 0.25 | 0.10 | 0.50–0.65 | 0.4–0.6 | — | 5.0–6.5 | — | 0.01–0.11 |
| L712.2 | 0.15 | 0.40 | 0.25 | 0.10 | 0.50–0.65 | 0.4–0.6 | — | 5.0–6.5 | — | 0.01–0.05 |
| L771.0 | 0.15 | 0.15 | 0.10 | 0.10 | 0.8–1.0 | 0.06–0.2 | — | 6.5–7.5 | — | 0.01–0.11 |
| L771.2 | 0.10 | 0.10 | 0.10 | 0.10 | 0.85–1.0 | 0.06–0.2 | — | 6.5–7.5 | — | 0.01–0.05 |
| L772.0 | 0.15 | 0.15 | 0.10 | 0.10 | 0.6–0.8 | 0.06–0.2 | — | 6.0–7.0 | — | 0.01–0.11 |
| L772.2 | 0.10 | 0.10 | 0.10 | 0.10 | 0.65–0.8 | 0.06–0.2 | — | 6.0–7.0 | — | 0.01–0.05 |

Notes:

Single numbers refer to maximum amounts. The alloys can include other elements in minor amounts, such as Ag, Sb, Co, Zn, Zr, V, Be and B, for example.

(1)Ag is present in the range of 0.4 to 1 wt. %.

(2)Ag is present in the range of 0.5 to 1 wt. %.

(3)This alloy contains 0.1 to 0.4 wt. % Sb, 0.1 to 0.4 wt. % Co, and 0.1 to 0.4 wt. % Zr, with Ti + Zr < 0.5 wt. %.

(4)V is present in the range of 0.06 to 0.20 wt. %.

(5)Be is present in the range of 0.04 to 0.7 wt. %.

(6)Be is present in the range of 0.1 to 0.3 wt. %.

(7)Be is present in the range of 0.15 to 0.3 wt. %.

(8)Pb may be present up to 0.1 wt. %.

(9)Be is present in the range of 0.003 to 0.007 wt. %, and B is less than 0.005 wt. %.

(10)Be is present in the range of 0.003 to 0.007 wt. %, and B is less than 0.002 wt. %.

Other Al—Zn—Mg alloys in accordance with the invention include:

2.0 to less than 3.5 wt. % Zn, 2.5 to less than 4 wt. % Mg, max. 2 wt. % total Fe and Mn in combination, max. 0.3 wt. % Si, max. 0.6 wt. % Cu, optionally up to 0.5 wt % Cr, dissolved Ti in the range of about 0.005 to 0.1 wt. %, and an undissolved nucleating agent in the range of about 0.002 to 0.1 wt. % for grain refining, the balance comprised of aluminum, incidental elements and impurities;

3.5 to less than 4.4 wt. % Zn, 3.2 to less than 4.2 wt. % Mg, max. 0.3 wt. % Fe, max. 0.3 wt. % Mn, max 0.2 wt. % Si, max. 0.6 wt. % Cu, optionally up to 0.5 wt. % Cr, dissolved Ti in the range of about 0.005 to 0.1 wt. %, and an undissolved nucleating agent in the range of about 0.002 to 0.1 wt. % for grain refining, the balance comprised of aluminum, incidental elements and impurities.

An important embodiment of this invention is the discovery that titanium dissolved in the alloy and present in the form of suspended, insoluble particles must both be controlled to certain levels to obtain small grain size. That is, the level of each of these two forms (dissolved and non-dissolved) must be controlled, in order to optimize the grain refinement practice for specified high strength aluminum casting alloys in accordance with tile invention. This embodiment is best considered and explained by example.

An important commercial grain refiner is the master alloy having the composition Al-3%Ti-1%B. This master alloy contains many microscopic particles of titanium diboride ($TiB_2$). These are suspended in the master alloy, and released into the melt when the master alloy is added to a bath of liquid aluminum. The particles are typically about one micron (10–6 meters) in diameter, and so are easily suspended in the liquid metal. They are also insoluble in molten aluminum at normal casting temperatures. The amount of addition of insoluble and soluble titanium present in boride particles may be calculated. The Ti/B ratio by weight in titanium diboride is equal to 2.2. Thus, in a Al-3%Ti-1%B master alloy, there will be 2.2% Ti (73% of the total Ti) present in the from of insoluble TiB2. The other 0.8% Ti (27% of total) dissolves in the liquid metal.

Similar calculations may be made for the commercial grain refiner Al-3%Ti-0.1%C. This master alloy contains numerous microscopic TiC particles. The Ti/C ratio for stochiometric TiC is equal to 4. Thus, in this master alloy, there will be 0.4% Ti (13% of total Ti) present in the form of relatively insoluble carbide particles.

The following examples are further illustrative of the invention.

Example 1

A series of melts of Al-4.5 wt. % Cu alloy were prepared, and small additions of titanium briquette were added to the melts to produce various dissolved Ti levels. This alloy, 4.5 wt. % Cu, remainder aluminum, is similar to a number of the AA 200 series casting alloys, which were discussed herein. The melt was allowed to sit for two hours, that all of the Ti added went into solution, and so that it would no longer produce grain refinement. During this time tile melt was held at a temperature of 730° to 750° C. which is sufficient to put all of the added Ti in solution.

A constant addition of a grain nucleating agent comprised of titanium and boron was made by adding a quantity of commercial Al-3%Ti-1%B (3 wt. % Ti, 1 wt. % B, remainder aluminum) master alloy to the melts. The addition made was equivalent to an increase of 0.002 wt. % B. or 0.006 wt. % Ti in the melt. Of the total 0.006 wt. % Ti added from the master alloy, 0.0044% Ti was present in the form of insoluble borides, and 0.0016% Ti in a dissolvable form.

Grain size samples were then taken by using a hockey puck test. In this test a steel ring was placed on top of a polished refractory block, and molten metal was poured inside the ring. The bottom surface was etched by placing briefly in acid, and the grain size was determined with a low powered binocular microscope, by using the line intercept method described in ASTM E112. The resulting grain size, as measured by the average intercept distance, is given below:

| Test No. | Alloy | Dissolved Ti | Insoluble Ti | Grain Size (microns) |
|---|---|---|---|---|
| 1 | Al-4.5% Cu | 0.176 wt. % | 0.004 wt. % | 158 |
| 2 | Al-4.5% Cu | 0.046 wt. % | 0.004 wt. % | 127 |
| 3 | Al-4.5% Cu | 0.021 wt. % | 0.004 wt. % | 107 |
| 4 | Al-4.5% Cu | 0.008 wt. % | 0.004 wt. % | 93 |

Only in the first test was the amount of titanium content sufficiently high (0.18%) to the chemical composition limits required by the Aluminum Association for 206 alloy, and for other similar AA 200 series alloys. However, this test produced the largest grain size. Reducing the dissolved Ti level significantly improved the grain size. That is the lower Ti levels resulted in significantly smaller grain sizes.

This result is contrary to the teaching of the art. It is the usual commercial practice to add Ti, in relatively large quantities, in the form of various master alloys. For the above results, it is apparent that the dissolved Ti content should be reduced, and minimized as far as possible, not increased as in the current practice.

Example 2

Two melts of an alloy similar to 712, except for the Cr content, were prepared. Each alloy had a different dissolved Ti content. The analyses of the two base alloys are given below.

| Alloy | wt. % Cr | wt. % Cu | wt. % Fe | wt. % Mg | wt. % Mn | wt. % Ni | wt. % Si | wt. % Ti | wt. % Zn |
|---|---|---|---|---|---|---|---|---|---|
| 712 | 0.002 | 0.002 | 0.16 | 0.58 | 0.38 | 0.011 | 0.04 | 0.177 | 4.93 |
| L712 | 0.002 | 0.002 | 0.16 | 0.59 | 0.38 | 0.011 | 0.04 | 0.032 | 5.09 |

To each of the above alloys an addition of 0.01% Ti was made in the form of Al-3%Ti-1%B master alloy. Grain size samples were then taken by using the standard test method specified by the American Aluminum Association. The resulting grain size, as measured by the average intercept distance, is given below:

| Alloy | Dissolved Ti (wt. %) | Insoluble Ti (wt. %) | Grain Size (microns) |
|---|---|---|---|
| 712 | 0.180 | 0.0073 | 133 |
| L712 | 0.032 | 0.0073 | 69 |

Example 3

Two heats of an Al-4%Cu-3% Zn (249) alloy were prepared, and tested in accordance with the same procedures used in examples 1–2. The composition of the base alloys are given below.

| Alloy | wt. % Cr | wt. % Cu | wt. % Fe | wt. % Mg | wt. % Mn | wt. % Ni | wt. % Si | wt. % Ti | wt. % Zn |
|---|---|---|---|---|---|---|---|---|---|
| 249 | 0.001 | 3.99 | 0.14 | 0.39 | 0.43 | 0.005 | 0.037 | 0.238 | 2.96 |
| 249 | 0.001 | 4.02 | 0.14 | 0.39 | 0.43 | 0.005 | 0.037 | 0.041 | 2.96 |

To each alloy an addition of 0.01% Ti was made in the form of Al-3%Ti-1%B alloy. The resulting as cast grain size is given below:

| Alloy | Dissolved Ti (wt. %) | Insoluble Ti (wt. %) | Grain Size (microns) |
|---|---|---|---|
| 249 | 0.241 | 0.0073 | 133 |
| L249 | 0.044 | 0.0073 | 69 |

In this alloy the best grain refinement was also found in the alloy which had solved Ti content.

Example 4

Two heats of an Al-7%Mg (535) alloy were prepared, and tested in accordance with the same procedures used in examples 1–3. The composition of the alloys are tabulated below.

| Alloy | wt. % Cr | wt. % Cu | wt. % Fe | wt. % Mg | wt. % Mn | wt. % Ni | wt. % Si | wt. % Ti | wt. % Zn |
|---|---|---|---|---|---|---|---|---|---|
| 535 | 0.0 | 0.004 | 0.15 | 6.98 | 0.18 | 0.002 | 0.05 | 0.196 | 0.0 |
| L535 | 0.0 | 0.004 | 0.15 | 7.04 | 0.18 | 0.002 | 0.05 | 0.036 | 0.0 |

To each alloy an addition of 0.01% Ti was made in the form of Al-3%Ti-1%B master alloy. Grain size samples were then taken by using the standard test method specified by the American Aluminum Association. The resulting grain size, as measured by the average intercept distance, is shown below:

| Alloy | Dissolved Ti (wt. %) | Insoluble Ti (wt. %) | Grain Size (microns) |
|---|---|---|---|
| 535 | 0.199 | 0.0073 | 82 |
| L535 | 0.039 | 0.0073 | 86 |

Since the statistical (Iσ) error associated with the determination of grain size is about 10%, for all practical purposes these two alloys have the same grain size. This result shows that this invention does not apply to Al—Mg alloys.

It is believed that this invention does not apply to Al—Si alloys (such as 356 alloy, which contains 7% Si and c. 0.4% Mg), or to Al—Si—Cu alloys (such as 319 alloy, which is Al-6%Si-3Cu).

Example 5

A permanent mold casting was selected to evaluate the new grain refining practice. The casting to be used in these trials was a design subject to hot cracking. The part selected was the support bracket shown in FIG. 1. This casting has two legs, each supported with a thin flange of metal on the outside of the leg. The casting is 11 inches wide (from left to right in FIG. 1), 5.2 inches high (from top to bottom in FIG. 1), and 1.5 inches thick (not shown in FIG. 1). The arrows indicate the four corner locations where cracks are observed in the castings, when subjected to a die penetrate test.

Two alloys were prepared. One was a conventional AA 206 alloy, which had about 0.20 wt. % of dissolved Ti. A total of 45 castings were poured with the conventional AA 206 alloy. The second melt had a much lower dissolved Ti content, 0.05 wt. % Ti. A total of 54 castings were poured from this new alloy. This alloy is called L206 below; the 'L' designating a low Ti content.

Aside from the difference in Ti content, the two alloys were nearly the same composition. An average of all chemical analyses, taken from sections cut from the casting, are tabulated below. All other casting parameters, such as pouring temperature and dissolved gas content, were maintained the same as far as possible.

| Alloy | wt. % Cr | wt. % Cu | wt. % Fe | wt. % Mg | wt. % Mn | wt. % Ni | wt. % Si | wt. % V | wt. % Zn |
|---|---|---|---|---|---|---|---|---|---|
| 206 | 0.001 | 4.32 | 0.12 | 0.23 | 0.39 | 0.002 | 0.061 | 0.011 | 0.005 |
| L206 | 0.001 | 4.40 | 0.12 | 0.18 | 0.27 | 0.002 | 0.061 | 0.008 | 0.002 |

A grain refiner addition was made to the furnace by adding a quantity of Al-10T-1B master alloy. Castings were poured. Then additional grain refiner was placed in mental transfer ladle, in the form of pieces of cut rod. Al-5Ti-1B and Al-1.7Ti-1.4B rod were both used to add nucleating particles. Additional castings were poured at the higher bottom addition levels.

In some castings the foot at the lower left hand side (below arrow 4 in FIG. 1) was cut off and subjected to metallographic examination. The piece was ground and polished, and etched with Keller's reagent. The grains were examined under a microscope with polarized light, and the average intercept distance (AID) was measured. The results of the measurements are shown below:

| Alloy | Addition Made | wt. % B Added | Dissolved wt. % Ti | Insoluble wt. % Ti | Grain Size (microns) |
|---|---|---|---|---|---|
| L206 | 10 Ti-1 B | 0.006 | 0.049 | 0.013 | 59 |
| L206 | 5 Ti-1 B | 0.02 | 0.040 | 0.044 | 56 |
| L206 | 1.7 Ti-1.4 B | 0.026 | 0.034 | 0.032 | 68 |
| 206 | 10 Ti-1 B | 0.006 | 0.211 | 0.013 | 120 |
| 206 | 5 Ti-1 B | 0.02 | 0.165 | 0.044 | 118 |
| 206 | 1.7 Ti-1.4 B | 0.026 | 0.209 | 0.032 | 99 |

For the Al-10%Ti-1%B master alloy 22% of the total Ti added was insoluble. For Al-5%Ti-1%B master alloy 44% of the Ti added is in the form of insoluble boride particles. For the Al-1.7%Ti-1.4%B master alloy, 100% of the Ti added is present in the form of insoluble borides. There is no dissolvable Ti in this case.

Two important facts may be drawn from this result. Firstly, in all cases the grain size in the L206 alloy is significantly smaller than in the conventional alloy. And secondly method of adding nucleating particles does not seem to be as important as maintaining a low dissolved Ti content in the casting.

All castings were examined for cracks by using the dye penetrate test. The inspection are shown below:

| Alloy | Casting Number | Location of Cracks |
|---|---|---|
| 206 | 3-2 | 3 |
| 206 | 3-1 | 3 |
| 206 | 3-3 | 1, 3, 4 |
| 206 | 7-1 | 2 |
| 206 | 7-2 | 2, 3, 4 |
| 206 | 7-3 | 1, 2, 3, 4 |
| 206 | 10-2 | 2, 3 |
| 206 | 10-3 | 1, 2 |
| 206 | 12-2 | 3 |
| 206 | 12-3 | 2 |
| L206 | 5 L-2 | 3 |

This is a very significant result. Ten of the 206 alloy castings (22% of the 45 casting poured) exhibited a total of 19 cracks. Only one of the L206 castings (5L-2, 1.9% of the 54 castings poured) was cracked, and only a single crack was observed. Thus, the ocurrence of hot cracks in L206 alloy castings was reduced by a factor of ten or twenty times, which is a marked improvement.

In a number of castings a tensile sample was cut from one of the legs of the casting. These samples were solution treated (T4 temper) and pulled until fracture, yielding the following test results:

| Alloy | Yield Strength (psi) | Ultimate Strength (psi) | Elongation (%) |
|---|---|---|---|
| 206 | 34,700 | 45,900 | 9.2 |
| L206 | 35,200 | 49,700 | 11.8 |

It can be seen that the new alloy also exhibits better mechanical properties in the final casting.

It can be seen from the above examples that in certain high strength casting allots maintaining the dissolved Ti content in the ingot at a level below about 0.1 wt. % produces the desired smaller grain size, and significantly reduced hot cracking. Further, it is preferred to maintain the dissolved Ti content below a maximum of 0.05 wt. %. And a still smaller maximum dissolved still smaller maximum dissolved Ti content of 0.02 wt. % will produce the smallest grains. The dissolved titanium can range from about 0.005 to 0.1 wt. %, with typical amounts of dissolved titanium being in the range of 0.01 to about 0.05 wt. %.

In the above examples the insoluble nucleating particles were microscopic borides, having a size in the range of 0.2 to 5 microns. These were added in the form of commercial Al—Ti—B master alloys. Grain refinement was accomplished in the aformentioned examples by additions of insoluble particles, whose weight was between 0.0064% and 0.064 that of the base alloy melt. (The above values include the weight of both the Ti and B in the boride particles.) The addition level of particles may be more or less than values, depending on the alloy used and the casting conditions encountered, but will generally be between 0.002% and 0.1%, and preferably between 0.003% and 0.06% by weight of the base alloy melt.

The insoluble nucleating particles or agents in commercial grain refiners used commercially today are TiC and TiB2. Both can be used to initiate nucleation to provide small grains in the aluminum alloys of the invention. Examples of master alloys which provide nucleating agents include Al-5%Ti-1B, Al-3%Ti-1%B, Al-2.5%Ti-2.5%B, Al1-1.5%Ti-4%B, and Al-3%Ti-0.1%C. While the invention has been demonstrated using nucleating particles containing Ti, it will be understood that other elements also from stable aluminides, borides or carbides. Thus, elements such as Nb, Sc, Ta, V, Y and Zr can be used to provide suitable grain refining compounds. The alloy ranges provided herein include all the numbers within the range as if specifically set forth.

The level of dissolved Ti may be reduced in aluminum alloy melts in the from of aluminum boron master alloys or boron containing master alloys.

It can readily be seen that the alloys of the invention will find commercial use in a number of products where high strength and light weight are required. Some example of aircraft, missile and other aerospace applications include: structural casting members, gear and pump housings, landing gear components, generator housings, aircraft fittings, supercharger housings, and compressors. Light weight is also important for fuel economy in automotive applications. Examples of vehicular members or near net shape cast prodocts for transportation applications include: cylinder heads, pistons, gear and air conditioning housings, spring hangers, superchargers, support brackets, front steering or rear knuckles, control arms, subframes and cross-members, differential carriers, transmission and belt tensioner brackets, and pedestal rocker arms.

Typically, cooling or solidification times for castings made in accordance with this invention can range from about 10 to 300 seconds, in order to obtain small grain size and improved hot tearing resistance. Grain sizes obtainable for cast products can range from 10 to 125 microns, preferably 20 to 100 microns, and typically 30 to 80 microns. In permanent mold castings the grains will be smaller, and in sand castings the grand size tends to be lager, because of slower cooling rates.

While the invention has been described in terms of preferred embodiments, the claims appended hereto are intended to encompass other embodiments which fall within the spirit of the invention.

What is claimed is:

1. A method of casting an aluminum base alloy to provide a near net shape cast product having improved hot crack resistance in the as-cast condition, the method comprising:

(a) providing a melt of an aluminum base alloy comprised of 2 to less than 3.5 wt. % Zn, 2.5 to 4 wt. % Mg, max. 2 wt. % total Fe and Mn in combination, max. 0.3 wt. % Si, max. 0.6 wt. % Cu, and optionally up to 0.5 wt. % Cr, the balance comprised of aluminum, incidental elements and impurities;

(b) maintaining dissolved Ti in the range of about 0.005 to 0.1 wt. % in said melt to improve the resistance of said alloy to hot cracking;

(c) adding a nucleating agent selected from the group consisting of metal carbides, aluminides and borides to said melt to provide an undissolved nucleating agent therein in the range of about 0.002 to 0.1 wt % for grain refining; and (d) solidifying said alloy to provide a near net shape cast product having a grain size of less than 125 microns and being free of hot cracks.

2. The method in accordance with claim 1 wherein said dissolved Ti is maintained in the range of 0.003 to 0.06 wt. %.

3. The method in accordance with claim 1 wherein said dissolved Ti is maintained in the range of 0.005 to 0.04 wt. %.

4. The method in accordance with claim 1 wherein said nucleating agent is $TiB_2$ or TiC, and the insoluble Ti added is maintained in the range of 0.003 to 0.06 wt. %.

5. The method in accordance with claim 1 wherein said cast product is a vehicular or aerospace cast product.

6. A method of casting an aluminum base alloy to provide a near net shape cast product having improved hot crack resistance in the as-cast condition, the method comprising:

(a) providing a melt of an aluminum base alloy comprised of 3.5 to less than 4.4 wt. % Zn, 3.2 to less than 4.2 wt. % Mg, max. 0.3 wt. % total Fe, max. 0.3 wt. % Mn, max. 0.2 wt. % Si, max. 0.6 wt. % Cu, and optionally up to 0.5 wt. % Cr, the balance comprised of aluminum, incidental elements and impurities;

(b) maintaining dissolved Ti in the range of about 0.005 to 0.1 wt. % in said melt to improve the resistance of said alloy to hot cracking;

(c) adding a nucleating agent selected from the group consisting of metal carbides, aluminides and borides to said melt to provide an undissolved nucleating agent therein in the range of about 0.002 to 0.1 wt. % for grain refining; and (d) solidifying said alloy to provide a near net shape cast product having a grain size of less than 125 microns and being free of hot cracks.

7. The method in accordance with claim 1 wherein said dissolved Ti is maintained in the range of 0.003 to 0.05 wt. %.

8. The method in accordance with claim 1 where said nucleating agent is $TiB_2$ or TiC, and the insoluble Ti added is maintained in the range of 0.003 wt. % to 0.06 wt. %.

9. The method in accordance with claim 1 where said cast product is a vehicular or aerospace cast product.

* * * * *